US006327976B1

(12) United States Patent
Stiel

(10) Patent No.: US 6,327,976 B1
(45) Date of Patent: Dec. 11, 2001

(54) METHOD FOR DETECTING A ROTATION ANGLE POSITION OF MOVEABLE CYLINDER OF A PRINTING MACHINE

(75) Inventor: Jürgen Alfred Stiel, Thüngen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/582,645

(22) PCT Filed: Jan. 29, 1999

(86) PCT No.: PCT/DE99/00231

§ 371 Date: Jul. 31, 2000

§ 102(e) Date: Jul. 31, 2000

(87) PCT Pub. No.: WO99/38689

PCT Pub. Date: Aug. 5, 1999

(30) Foreign Application Priority Data

Jan. 30, 1998 (DE) ..... 198 03 558

(51) Int. Cl.[7] ..... B41F 13/24

(52) U.S. Cl. ..... 101/247; 101/248; 101/216; 101/181

(58) Field of Search ..... 101/216, 219, 101/247, 248

(56) References Cited

U.S. PATENT DOCUMENTS

| | | | | |
|---|---|---|---|---|
| 4,376,413 | * | 3/1983 | Kuroda | 101/247 |
| 4,458,893 | * | 7/1984 | Ruh | 101/248 |
| 4,665,498 | * | 5/1987 | Buschmann et al. | 101/184 |
| 4,953,462 | * | 9/1990 | Kroser | 101/216 |
| 5,357,860 | * | 10/1994 | Shibata et al. | 101/219 |
| 5,481,971 | * | 1/1996 | Grützmacher et al. | 101/183 |
| 5,610,491 | | 3/1997 | Gotz et al. . | |
| 5,656,909 | | 8/1997 | Gotz et al. . | |
| 5,668,455 | | 9/1997 | Gotz et al. . | |
| 5,682,818 | * | 11/1997 | Braun et al. | 101/216 |
| 5,826,505 | * | 10/1998 | Volz et al. | 101/183 |
| 5,887,526 | | 3/1999 | Zahnd . | |
| 5,924,362 | * | 7/1999 | Volz et al. | 101/484 |

FOREIGN PATENT DOCUMENTS

| | | | | |
|---|---|---|---|---|
| 40 34323 A1 | * | 10/1990 | (DE) . | |
| 196 14 818 | | 10/1997 | (DE) . | |
| 197 20 952 | | 11/1998 | (DE) . | |
| 0 693 374 | | 1/1996 | (EP) . | |
| 62 44454 | * | 2/1987 | (JP) | 101/232 |

* cited by examiner

*Primary Examiner*—Eugene Eickholt
(74) *Attorney, Agent, or Firm*—Jones, Tullar & Cooper, PC

(57) ABSTRACT

The rotation angle position of a moveable component, such as a cylinder, is detected or determined through a method in which the detected rotation angle position is modified using a correction value when the moveable component is in a second position.

9 Claims, 3 Drawing Sheets

METHOD FOR DETECTING A ROTATION ANGLE POSITION OF MOVEABLE CYLINDER OF A PRINTING MACHINE

FIELD OF THE INVENTION

The present invention relates to a method for determining an angle of rotation position of a movable cylinder of a printing press.

DESCRIPTION OF THE PRIOR ART

A device for an angular position sensor is known from DE 196 14 818 A1, wherein a stator of the angular position sensor is arranged at a fixed angle in respect to the lateral frame.

DE 197 20 952 A1 describes a method for compensating a rotating movement superimposed on the rotating movement of a cylinder because of an eccentric movement. The compensation is performed by a control circuit, which is supplied with the actual angle of rotation of the cylinder in respect to an eccentric device, as well as with the actual angle of rotation of the eccentric device, or with an angular function derived therefrom.

SUMMARY OF THE INVENTION

The object of the present invention is directed to providing a method for determining an angle of rotation of a movable cylinder of a printing press.

In accordance with the invention, this object is attained by using an angle of rotation position sensor. A first angle of rotation of the component in a reference position is determined. In a second position of the component, a second angle of rotation is also determined. A difference between the two is used as the correction value for determining the actual angular position of the component in its second position.

In connection with the drive mechanism in accordance with the present invention for cylinders of a printing press, it is possible in an advantageous manner to arrange an angle of rotation position sensor in any arbitrary manner, i.e. an angle of rotation position of the angle of rotation position sensor in respect to the lateral frame need not be constant during the movement of the cylinder.

It is also possible to remove errors, for example as a result of production-related tolerances.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
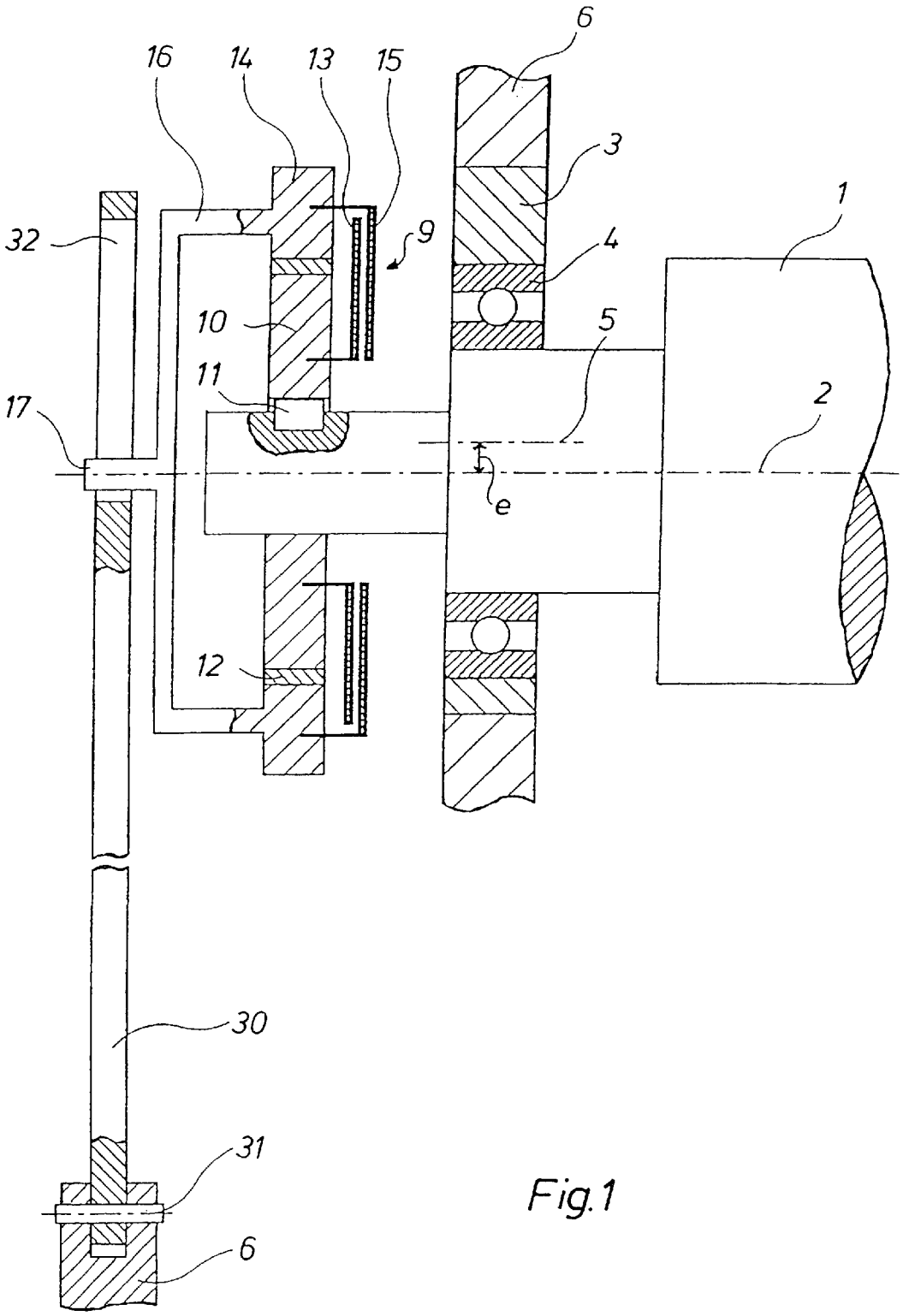
FIG. 1, a schematic representation of a longitudinal section through a bearing of a cylinder, FIG. 2, a schematic representation of the lateral view in accordance with FIG. 1, and in FIG. 3, a schematic representation of a block wiring diagram of a drive control.

FIG. 1 represents a longitudinal section of a rotating component of a printing press, for example a cylinder 1, which is rotatably driven around its longitudinal axis, called the axis of rotation 2 of the cylinder in what follows, and which is pivotable around a pivot axis 5. The cylinder 1 is rotatably seated in an eccentric bushing 3 by a bearing 4 on its two outer cylinder journals, only one of which outer cylinder journals is represented in FIG. 1. The eccentric bushing 3 itself is rotatably seated in a sliding bearing in a machine frame 6. The cylinder 1 is pivoted in a generally known manner about the pivot axis 5 by operation of the eccentric bushing 3. The pivot axis 5 is also the axis of rotation of the eccentric bushing 3 in the machine frame 6. The distance between the axis of rotation 2 of the cylinder and the pivot axis 5 is the eccentricity e.

An angle of rotation position sensor 9 has been fastened, in a manner fixed against relative rotation in respect to the axis of rotation 2 of the cylinder, on the outermost journal end of the cylinder 1 as seen in FIG. 1. The angle of rotation position sensor 9 is comprised of an inner ring 10 and a circular first measuring disk 13, which is rigidly connected with it. The application, of the inner ring 10 on the journal of the cylinder 1 in a manner fixed against rotation, is indicated by a cotter pin 11. The first measuring disk 13 has a known circular graduation with a multitude of lines extending in the radial direction. An outer ring 14, which is slidingly rotatably seated on the inner ring 10, and with which a second circular disk 15 is rigidly connected, encloses the inner ring 10. This second or scanning disk 15 is provided with a multitude of photo elements for scanning the line graduation of the first or measuring disk 13. The relative angle of rotation position of the first or measuring disk 13 with respect to the second or scanning disk 15, which is therefore used as a reference (relation) for the angle of rotation position of the first measuring disk 13, is determined by means of photo-electrical scanning, which photo-electric scanning merely represents a preferred embodiment of the scanning process, but to which the invention is not exclusively limited, and by the angle of rotation position of the cylinder 1 in respect to the outer ring 14, which is used as the reference element 14 and which has the second or scanning disk 15, called reference disk 15 in what follows. The outer ring 14 and the reference disk 15 constitute a reference element for the angular position sensor 9.

Figure 2:
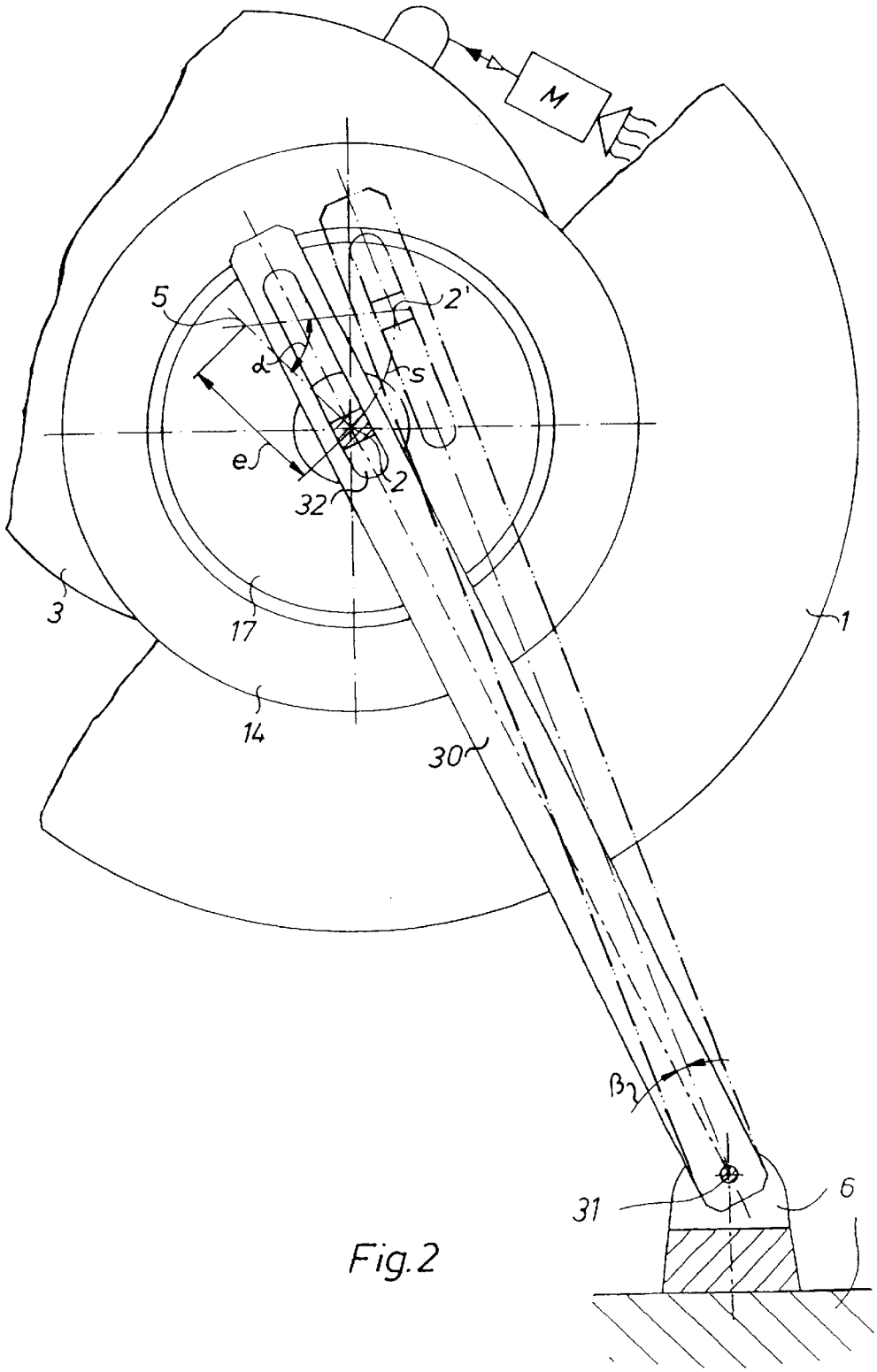
Figure 3:
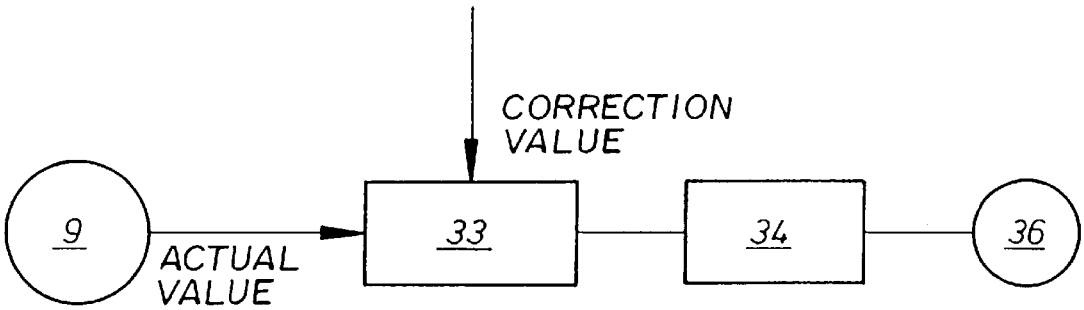

A support arm 30 is seated, pivotable around a pivot axis 31, on the machine frame 6. On its end remote from the pivot axis 31, the support arm 30 has an elongated recess 32, which, as seen in FIG. 2 is embodied as a simple elongated hole in the preferred embodiment. The pivot axis 31 of the support arm 30 extends parallel with the axis of rotation 2 of the cylinder. A rigid guide element 17, which is rigidly connected with the reference element 14, is force-guided in the course of a pivot movement of the cylinder 1. The reference element 14 is maintained in its zero position during a printing operation by means of the forced guidance, in particular during pivoting of the axis of rotation 2 of the cylinder.

The arrangement in accordance with FIG. 1 is represented in FIG. 2 in a front view on the cylinder 1. By operation of a motor M or a working cylinder, which acts on the eccentric bushing 3, the cylinder 1 is pivoted around the pivot axis 5, which simultaneously represents the pivot axis of the cylinder 1, by an angle $\alpha$ from its zero position, namely the printing position. In the course of this pivot movement, the axis of rotation 2 of the cylinder describes an arc s of a segment of a circle and moves into the pivoted-away position indicated by 2', as seen in FIG. 2.

In the preferred embodiment in accordance with FIGS. 1 and 2, the reference element 14 is rigidly connected with the guide element 17, which is force-guided at a close lateral distance in the recess 32 of the support arm 30. In the preferred embodiment the guide element 17 is designed as a simple square bolt, which is guided, sliding in the recess 32, in a purely translatory manner; tilting is prevented by this. In the course of pivoting the cylinder 1, the angle of rotation position of the cylinder 1 does not change by the amount of the pivot angle $\alpha$ of the cylinder 1, but by the amount of the smaller pivot angle $\beta$ of the support arm 30.

Thus, the cylinder 1 can be pivoted out of a first operating position, for example "print ON", into a second operating position "print OFF". If the cylinder 1 is arranged to be not rotatable, for example in relation to the eccentric bushing 3, the rotor 13 and the stator 15 of the angle of rotation position sensor 9 rotate in respect to each other.

A second actual value $\beta$ 2, which is in relation to the second operating position, is determined. A correction value is fixed from a difference between the actual value $\beta$ 1, determined in a first operating position, and the actual value $\beta$ 2. If the cylinder is now driven in the second operating position, a computer 33 is supplied with the previously determined correction value and corrects the actually determined actual value by this correction value during the operation of the cylinder in its second operating position. This means that the actual value of the rotating component 1, as well as the correction value are determined by a single angle of rotation position sensor 9.

This correction value can also be calculated from the geometric relationships and can be determined without a measurement by means of an angle of rotation sensor.

Thus, a pre-calculated correction value is supplied to the computer 33 as a "manually" determined constant value.

It is also possible to fix a plurality of correction values for the entire course between the first and second operating positions. For this purpose, it would be possible, for example, to determine correction values as a function of the chronological course of the position changes of the cylinder 1, i.e. a function of correction values depending on the time.

It is also possible to assign a position sensor to the cylinder 1 which determines a position of the eccentric bushing 3, and therefore a position of the axis of rotation of the cylinder in respect to the machine frame 6. By means of this, it is possible to determine correction values as a function of the position of the cylinder 1.

It is also possible to determine the correction values as a function of time, or of the position, either in discrete steps or continuously.

The position of the cylinder is understood to mean the position of the axis of rotation 2 of the cylinder 1 in relation to the machine frame 6.

An output element 34 is connected downstream of the computer 33 for controlling a drive motor 36 for driving the cylinder 1.

While a preferred embodiment of a method for detecting a rotation angle position of a moveable cylinder of a printing machine in accordance with the present invention has been set forth fully and completely hereinabove, it will be apparent to one of skill in the art that a number of changes in, for example, the overall size of the cylinder, the drive for the cylinder and the like could be made without departing from the true spirit and scope of the present invention which is accordingly to be limited only by the following claims.

What is claimed is:

1. A method for determining an angle of rotation portion of a moveable rotating component of a printing press including:

providing an angle of rotation position sensor;

using said angle of rotation position sensor and determining a first angle of rotation position of the rotating component in a first, reference position of the component;

using said angle of rotation position sensor and determining a second angle of rotation position of the rotating component in a second position of the component;

determining a difference between said first angle of rotation position and said second angle of rotation position;

using said difference as a correction value; and determining an actual angular position of the rotating component in said second position using said correction value.

2. The method of claim 1 further including using said angle of rotation position sensor for determining said correction value.

3. The method of claim 1 further including determining said correction value using geometric relationships.

4. The method of claim 1 further including determining a plurality of said correction values.

5. The method of claim 1 further including determining said correction value as a function of chronological progress in the change of position of said rotating component.

6. The method of claim 1 further including assigning a position sensor to the rotating component and determining said correction value as a function of a position of the rotating component.

7. The method of claim 1 wherein the rotating component is a roller.

8. The method of claim 1 wherein the rotating component is a cylinder.

9. The method of claim 1 further including movably seating the rotating component in eccentric bushings.

* * * * *